United States Patent [19]

Wilson

[11] 4,294,500

[45] Oct. 13, 1981

[54] ROTARY ELECTRICAL JUNCTION ASSEMBLY

[76] Inventor: Jack A. Wilson, 502 N. Santa Fe, Salina, Kans. 67401

[21] Appl. No.: 71,191

[22] Filed: Aug. 30, 1979

[51] Int. Cl.[3] ..... H01R 39/08; H01R 39/14

[52] U.S. Cl. ..... 339/5 M; 310/232; 339/5 P

[58] Field of Search ..... 339/5 R, 5 M, 5 P, 8 R, 339/8 A; 310/232, 239, 241, 242

[56] References Cited

U.S. PATENT DOCUMENTS

| | | | |
|---|---|---|---|
| 1,797,607 | 3/1931 | Despard et al. | 339/8 A |
| 2,404,969 | 7/1946 | Liddington | 339/5 M |
| 2,453,073 | 11/1948 | Jones | 339/5 M |
| 2,509,931 | 5/1950 | Krantz | 339/5 M |
| 2,523,081 | 9/1950 | Wendt | 339/5 M |
| 2,820,207 | 1/1958 | Roy et al. | 339/5 P |
| 3,544,949 | 12/1970 | Panajuk et al. | 339/8 R |
| 3,619,681 | 11/1971 | Ginkel et al. | 310/232 |
| 3,659,627 | 5/1972 | Zimmerer et al. | 239/710 |
| 4,068,909 | 1/1978 | Jacobson et al. | 339/5 R |
| 4,098,546 | 7/1978 | Swartz et al. | 339/5 R |

FOREIGN PATENT DOCUMENTS

| | | | |
|---|---|---|---|
| 2311804 | 9/1973 | Fed. Rep. of Germany | 310/241 |

OTHER PUBLICATIONS

"Dependable Electrical Circuitry", Valmont Industries, Inc., Brochure, pp. 14, 15, (1977).

*Primary Examiner*—Eugene F. Desmond
*Attorney, Agent, or Firm*—Fishburn, Gold and Litman

[57] ABSTRACT

A rotary electrical junction assembly includes a rotor and a stator separable into halves for installation and maintenance. Preferably, the rotor has brushes and the stator has split slip rings engaged by the brushes. The slip ring halves are interconnected with corresponding ring halves and are positioned on individual nonconductive backing members stacked together to form slip ring stacked halves mounted on the stator halves. The backing members are semicircular and each includes a circumferential insulator wall with opposite ends which overlap to provide concinuous insulation between adjacent slip rings. The brushes are mounted on brush racks having rollers to engage tracks on the stator. A split outer housing covers the rotor and stator and has recesses receiving the brush racks. The housing is clamped onto a rotary support member and the brush racks revolve about the stator upon rotation of the rotor support member, thereby providing continuous conductive contact between the brushes and slip rings. Alternatively, the stator may have brushes and the rotor may have split slip rings.

13 Claims, 11 Drawing Figures

Fig. 1.
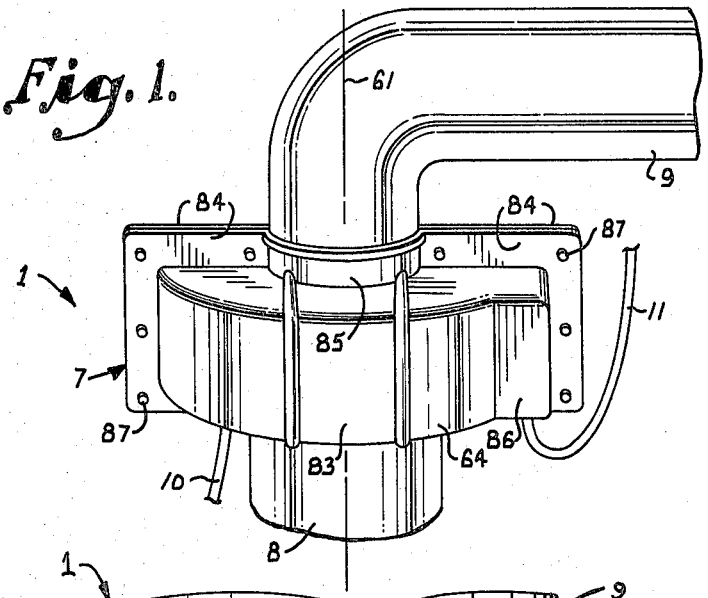
Fig. 2.
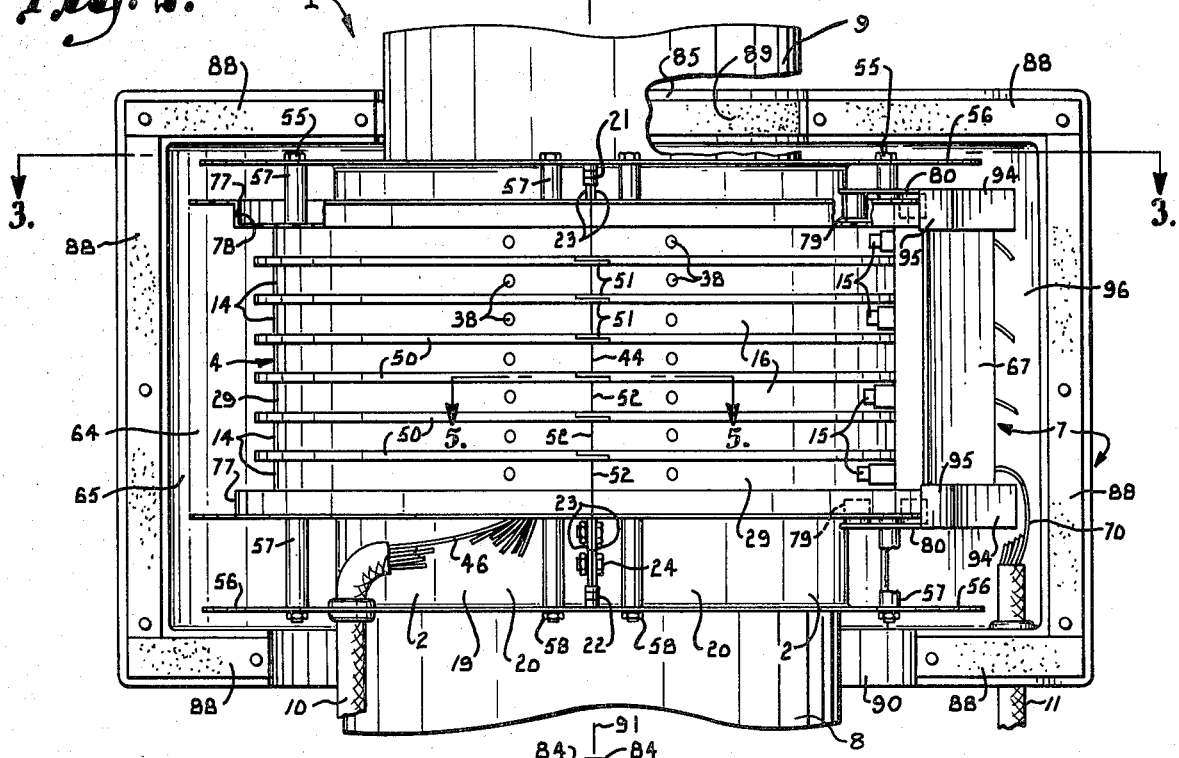
Fig. 3.

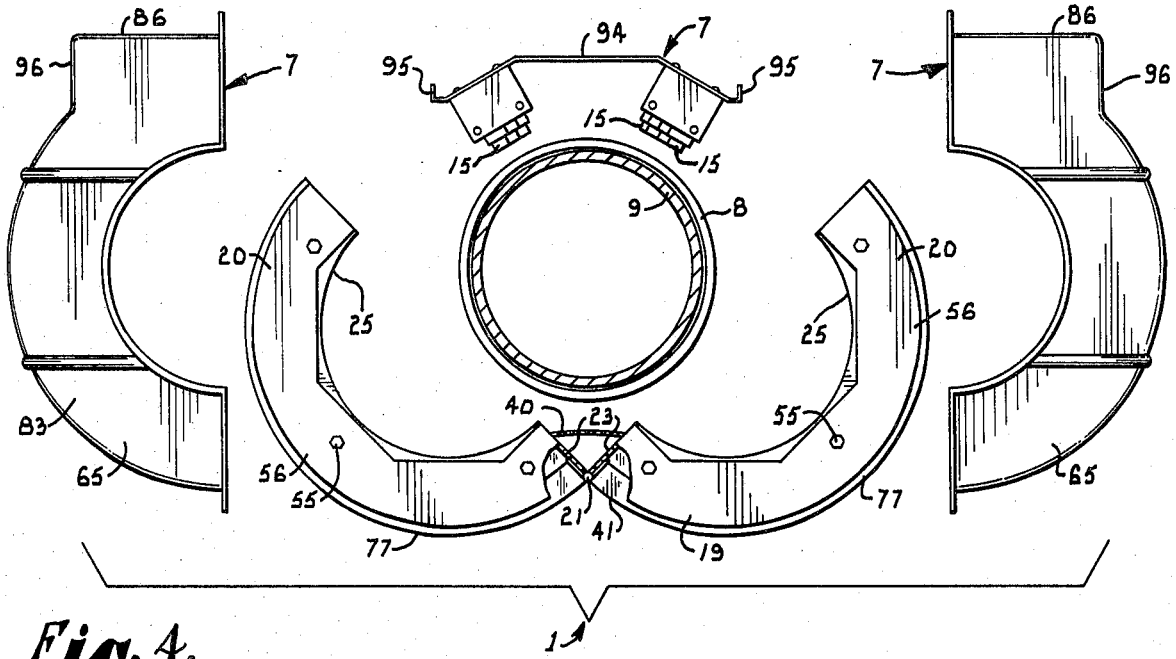
Fig. 4.
Fig. 5.
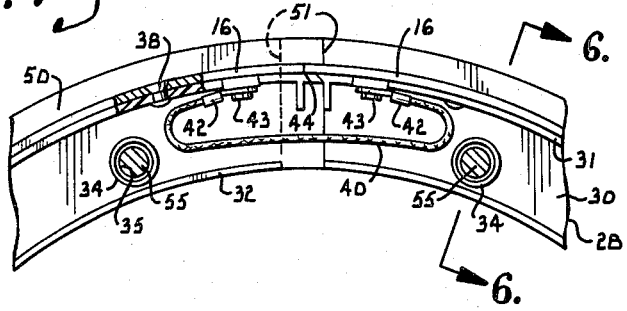
Fig. 6.
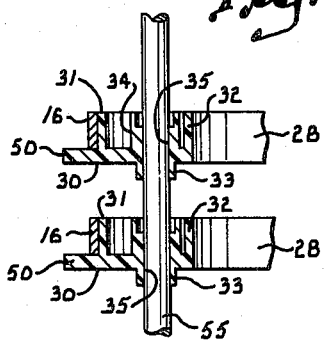
Fig. 7.
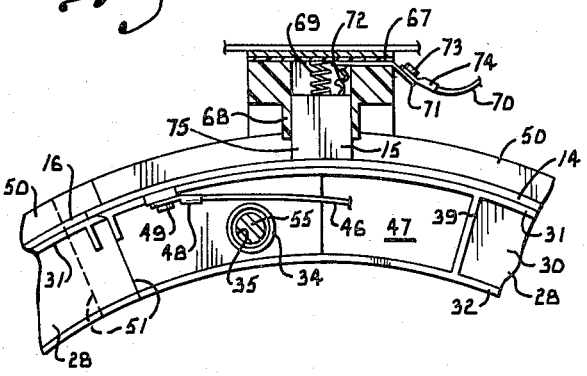
Fig. 8.
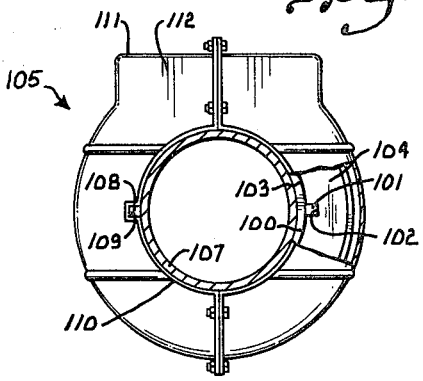

ROTARY ELECTRICAL JUNCTION ASSEMBLY

FIELD OF THE INVENTION

The present invention relates to rotary electrical junction devices and, more particularly, to such a device having a laterally separable rotor and stator to facilitate installation and maintenance of the assembly.

BACKGROUND OF THE INVENTION

In order to supply electrical power to devices which rotate or revolve relative to the source of power, it is a common practice to provide an arrangement of brushes and contact rings, known as slip rings, in continuous mutual sliding contact. Either the brushes or rings may rotate while the others are stationary. When such an arrangement is employed on a large rotating structure, such as a large agricultural center pivot irrigation sprinkler of the type disclosed in U.S. Pat. No. 3,659,627, great difficulties arise as it becomes necessary to replace the rings because of wear, since the water supply for such a sprinkler system generally passes through the axis of the rings. It is often necessary to substantially dismantle the structure in order to make repairs since the slip rings in such rotary junction devices are often continuous. Such dismantling can be complex, time consuming and therefore expensive.

SUMMARY AND OBJECTS OF THE INVENTION

The rotor junction of the present invention overcomes the difficulties of prior junction devices by providing rotor and stator assemblies which are separable into halves which can be removed laterally from the support members, thus rendering dismantling of the support members unnecessary.

The principal objects of the present invention are: to provide an improved rotary electrical junction assembly for communication of electrical power between relatively rotating members; to provide such an assembly which is adaptable to a wide variety of rotary connections; to provide such an assembly which does not require separation and disassembly of rotary and stationary support members along the axis of relative rotation for maintenance of the assembly; to provide such an assembly wherein the stationary and rotary subassemblies thereof are formed in laterally removable halves to facilitate installation and maintenance thereof; to provide such an assembly including split slip rings engaged by brush members; to provide such an assembly wherein the slip rings are assembled to form a pair of hinged half ring stacks; to provide such an assembly wherein the ring halves are separated by circumferentially extending insulator walls and wherein the ends of corresponding insulator walls of the stack halves overlap to provide continuous insulation between the rings; to provide such an assembly wherein the slip ring halves may be formed with relative ease by cutting and shaping metal strip stock; to provide such an assembly which can be easily sealed against inclement weather conditions; to provide such an assembly wherein the brush members are self-adjusting and maintain effective electrical contact with the slip rings even after substantial wear of the brush members has occurred; and to provide such a rotary electrical junction assembly which is economical to manufacture, convenient to install and maintain, capable of long operating life, and which is particularly well adapted for its intended purpose.

Other objects and advantages of the present invention will become apparent from the following description taken in connection with the accompanying drawings wherein are set forth, by way of illustration and example, certain embodiments of this invention.

BRIEF DESCRIPTION OF THE DRAWINGS

FIG. 1 is a perspective view of a rotary electrical junction assembly embodying the present invention and shown installed on stationary and rotary support members such as of a center pivot irrigation sprinkler system or the like.

FIG. 2 is an enlarged elevational view of the rotary junction assembly with a portion of a housing removed to illustrate internal details of the assembly.

FIG. 3 is a fragmentary plan view of the rotary junction assembly with portions broken away to show details of the brush racks engaging a guide track of the stator and showing engagement of the housing with the brush racks.

FIG. 4 is an exploded plan view of the rotary junction assembly at a diminished scale.

FIG. 5 is a fragmentary plan view showing a flexible means connecting slip ring halves.

FIG. 6 is a fragmentary sectional view taken on line 6—6 of FIG. 5 and showing normally nesting slip ring half backing members in spaced or separated relation.

FIG. 7 is a fragmentary plan view of the rotary junction assembly with portions broken away to show details of the engagement of a brush with a slip ring.

FIG. 8 is a plan view at a diminished scale of a modified form of rotary junction assembly wherein the rotor and stator are mounted as by key members respectively to the rotary and stationary support members.

DESCRIPTION OF THE PREFERRED EMBODIMENT

Figure 9:
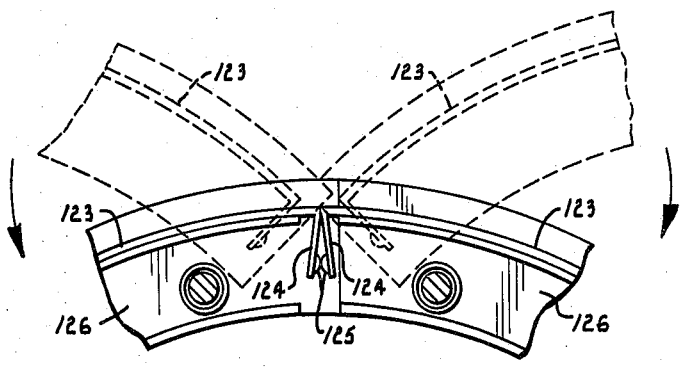
FIG. 9 is a fragmentary plan view of a modified form of split slip ring arrangement wherein associated halves of each ring are interconnected by means of separable contacts.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a split construction rotary electrical junction assembly including separable stator sections such as halves 2 defining a stator 4 and separable rotor sections such as halves 5 defining a rotor 7 relatively rotatable to the stator. The stator 4 is mounted on a stationary support member 8, and the rotor 7 is mounted on a rotary support member 9, FIG. 1. The rotary junction assembly 1 provides electrical communication between stationary electrical means, such as a source of electrical power (not shown), represented by the stationary cable 10, and revolving electrical means associated with the rotary support member 9, such as motors, valves or the like (not shown), represented by the revolving cable 11 and is disconnectible from the support members 8 and 9 by spreading apart the respective portions and moving the same laterally away from the support members 8 and 9.

Each of the stator 4 and rotor 7 includes respective contact means. In the illustrated example, one of the contact means is a plurality of slip rings or collector rings 14, and the other contact means is a plurality of brushes 15. The brushes 15 are in continuous sliding conductive contact with the slip rings 14 to provide continuous electrical communication between the stationary cable 10 and the rotating cable 11. According to the present invention, each of the slip rings 14 is separable into associated portions such as substantially similar ring halves 16. Either the rotor or the stator can have brushes or rings which are relative rotatable.

In the preferred embodiment of the present invention, the slip rings 14 are positioned on the stator 4. Basic support is provided for the rings 14 by an annular inner stator member 19 which is separable into sections, such as halves, thirds, quarters or the like and in the illustrated example, is substantially spool-shaped and formed in halves. The spool halves 20 are connected at one side thereof such as by an upper hinge 21 and a lower hinge 22 connected to respective stator mounting webs 23 on each side of the spool halves 20 (see FIGS. 2 and 4). The spool halves 20 are connected at the other side by removable fasteners 24, such as nuts and bolts, passing through the webs 23 thereof whereby the spool halves 20 are conveniently and removably clamped onto the stationary support member 8. Fasteners 24 are employed on the hinged side also since the hinges 21 and 22 are spaced radially from the stationary support member 8. In most cases, frictional engagement between an inner cylindrical surface 25 of the spool member 19 and the stationary support member 8, provided by the clamping action of the fasteners 24, is sufficient to securely position the spool member 19 on the stationary support member 8.

Structure, also of separable sections such as halves is provided for mounting and isolating the slip rings 14. In the preferred embodiment, a plurality of slip ring half backing members 28 is provided, FIGS. 5, 6 and 7. The backing members 28 are semi-annular members formed of insulation material and adapted for assembly into stacks 29 thereof. As illustrated in cross-section in FIG. 6, each backing member includes a base wall 30 with an outer wall 31 and an inner wall 32 upstanding therefrom. Each of the backing members 28 includes at least two alignment projections such that the relative position of adjacent backing members may be maintained. In the illustrated example, the projections comprise lower tubular projections 33 depending from a lower surface of the base wall 30. Each backing member includes an upper tubular member 34 upstanding from the base wall 30 and sized and shaped to receive the lower projection 33 of an adjacent backing member in nesting relation. The lower and upper tubular projections 33 and 34 are aligned on each backing member and on adjacent backing members 28 and a bore 35 extends therethrough.

The outer wall 31 provides a means of attaching the slip ring halves 16 to the stator 4. The slip ring halves 16 are preferably preformed and attached to the outer walls 31 of the backing members 28 such as by flush, countersunk rivets 38, FIG. 2. The slip ring halves 16 are preferably formed from an alloy such as a hard brass to thereby provide good electrical conductive properties in addition to resistance to wear from contact of the brushes 15 therewith. The slip ring halves 16 may be conveniently formed by cutting strip stock of brass to the appropriate size, drilling and countersinking holes for the rivets 38, and forming the strip into a semicircular shape. The outer wall 31 provides support to the associated ring half 16 to resist deformation of the ring half by contact of the brush 15 associated therewith. The exemplary backing member 28 is provided with circumferentially spaced radial walls 39, FIG. 7, to further stiffen the outer wall 31.

Electrical continuity between corresponding slip ring halves 16 in the two stator halves 2 is accomplished such as by flexible conductive jumper straps 40, FIG. 5. The jumpers 40 may be connected on the hinged side 41 of the stator 4 by soldering or, as in the illustrated example, by means of screw lugs 42 and screws 43 adjacent the interface 44 between the ring halves 16. Connection of the individual conductors 46 of the stationary cable 10 to the slip rings 14 may be made in a similar manner. For this purpose the base walls 30 of the backing members 28 are provided with respective openings 47 through which the conductors 46 may be routed (see FIG. 7). The conductor 46 is provided with a lug 48, such as a screw lug, for attachment by means of a screw 49 to one of the slip ring halves 16.

In order to provide positive insulation between adjacent slip rings 14, each of the backing members 28 is provided with a radially projecting, circumferentially extending insulator wall 50. In the illustrated example, FIG. 6, the insulator wall 50 is an extension of the base wall 30 of each backing member 28. It is desirable to avoid air gaps between the ends of the insulator walls 50, particularly when the rotary junction assembly 1 is employed where moisture is present, such as on a center pivot irrigation system. The passage of fluid such as water through the stationary and rotary support members 8 and 9 often tends to have a cooling effect on the junction assembly 1 and creates the possibility of condensation on the parts of the assembly 1, particularly during humid conditions. Such condensation combined with metal dust from wear of the slip rings 14 and brushes 15 may collect in the gap between the ends of the insulator walls 50, resulting in short circuits and arcing between the slip rings 14. In order to avoid the above described situation, the ends 51 of the insulator walls 50 are overlapped such as illustrated in FIGS. 2, 5 and 7. The ends 51 of the insulator walls 50, preferably the ends of the base wall 30, extend circumferentially past the ends 52 of the slip ring halves 16 and are about half the thickness of the insulator and base walls, such that the ends of said walls in corresponding backing members 28 of the stack halves 29 overlap in a manner similar to what is known as a "scarf joint" (see FIG. 2), the half thickness ends 51 combining to form a full thickness joint.

The stacks 29 of backing members 28 with the slip ring halves 16 thereon are assembled by placing the backing members 28 in side-by-side relationship and interfitting the lower tubular projections 33 of each into the upper tubular projection 34 of the adjacent backing member. With reference to FIG. 2, the stack halves 29 are mounted onto the spool halves 20 by connecting means such as bolts 55 passing through the aligned bores 35 of the backing members 28 and through upper and lower flanges 56 of the spool halves 20. Tubular spacers 57 are employed to position the stack halves 29 in the desired relation on the spool halves 20, and nuts 58 secure the bolts 55 in place.

In the preferred embodiment, the assembled stator sections such as halves 2 are connected at one side 41 by the hinges 21 and 22 attached to the web 23. The stator structure 4 may thus be conveniently installed or removed from the stationary support member 8 by use of the fasteners 24 in the webs 23 on each side of the stator 4. The interface between the webs 23 of the stator 4 defines a stator split plane, represented by the line 60 in FIG. 3, which passes through and includes the axis of rotation 61 (see FIG. 1) of the rotor 7 and rotary support member 9. While it would be possible to form the stator 4 in a manner other than with the stator portions formed in substantially similar portions, such as in thirds, quarters and the like, and with a separation pattern other than the stator split plane 60, the above described configuration is found to be the most convenient and economical.

In the preferred embodiment of the present invention, the brushes 15 are positioned on means associated with the rotor 7. The rotor 7 includes a housing 64 formed in separable sections such as housing halves 65. While it would be possible to attach the brushes 15 directly to the housing 64, it has been found more convenient, in terms of alignment of the brushes 15 with the slip rings 14 for assembly of the rotary junction 1, to make the sub-assemblies of brushes separable from the housing.

With reference to FIGS. 2, 3, and 7, the brushes 15 are mounted on brush racks 67. The brush racks 67 may consist of individual brush holders stacked together (not shown) in a manner similar to that of the backing members 28 of the stator or, as illustrated, are structures adapted to mount a plurality of individual brushes 15 thereon. As shown in FIG. 7, each brush 15 is positioned in a brush guide portion 68 of the rack 67 for resilient movement therein. A resilient means, such as a spring 69, is employed to urge the brush 15 into engagement with an associated slip ring 14. The resilient means permit the brushes to be substantially self adjusting to compensate for wear due to frictional contact with the slip rings 14.

Connection of the individual conductors 70 of the revolving cable 11 to the brushes 15 may be made in any conventional manner. In the illustrated example, a tab 71 in communication with the brush 15 by means of a wire 72 and having a screw 73 associated therewith, is provided. The conductor 70 has a screw lug 74 for engagement with the tab 71. In order to prevent the leading edges 75 of the brushes 15 of either of the racks 67 from arriving simultaneously at the interfaces 44 between the ring halves 16, which might result in excessive deformation of the backing members in addition to increased friction, the brushes 15 are preferably positioned on the brush racks 67 in a non-aligned or staggered pattern, such as a helical pattern as illustrated in FIG. 2.

The stator 4 includes guide means engaged by the brush racks 67. In the illustrated example, FIG. 2, upper and lower annular guide racks 77 are positioned on the respective opposite end faces of stator 4. Each of the guide tracks 77 includes a cylindrical wall 78, and each brush rack 67 includes guide rollers 79 for engagement with the guide tracks 77. Preferably, the rollers 79 are formed from a low friction material, such as nylon, and are mounted on respective roller mounting plates 80 projecting from the upper and lower ends of the brush rack 67. The guide tracks 77 are formed in portions such as halves, as are the other annular portions of the stator. As shown in FIG. 2, the guide tracks 77 may be so constructed as to form the end faces of the stack halves 29. It is necessary to engage the brush rack rollers 79 with the portions of the guide tracks 77 on one half of the stator 4 before clamping same onto the stationary support member 8.

The housing 64 is an enclosure for exclusion of contaminants such as dust, rain, insects, and the like from the working parts of the rotary junction device 1. Referring to FIGS. 1, 2, and 4, each housing half 65 includes a cylindrical shell portion 83 with a flange 84 extending along the boundaries thereof. A half collar 85 is provided on one end of the housing 64 for engagement with the rotary support member 9. Each housing half 65 further includes a brush rack receiving portion 86 adapted for engagement with the brush racks 67. The flanges 84 provide a means of attaching the housing halves 65 together, as by fasteners 87 such as nut and bolts, to thereby clamp the housing halves 65 onto the rotary support member 9. In order to seal the interface between the flanges 84, flange gaskets 88 are provided. In a similar manner, the collar 85 is provided with a collar gasket 89. The housing 64 is provided with an opening 90 on the side opposite the collar 85 to allow clearance of the stationary support member 8 and the stationary cable 10. In the preferred rotary assembly 1, the housing halves 65 are substantially bilaterally symmetrical and the flanges 84 define a rotor split plane represented by the line 91 in FIG. 3. The rotor split plane 91 is, therefore, centrally located and passes through the axis of rotation 61. The housing 64 is preferably formed, as by molding, from a somewhat flexible insulation material, such as polyvinyl chloride.

In most cases, particularly when there are a large number of slip rings 14 and brushes 15, the brushes 15 are positioned on more than one brush rack 67. In such a case, it is desirable to connect the brush racks 67 for simplicity. Referring to FIG. 3, the brush racks 67 are connected by brush connection brackets 94. The end portions 95 of the connection brackets 94 are formed in a manner for engagement with walls 96 of the brush rack engaging portion 86 of the housing halves 65. Upon rotation of the rotary support member 9 having the housing 64 clamped thereto, engagement of the walls 96 of the brush rack engaging portions 86 of the housing with the ends 96 of the connection brackets 94 causes the brush racks to revolve about the axis of rotation 61, thereby revolving the brushes 15 about the slip rings 14. Continuous contact of the brushes with the slip rings maintains electrical continuity between the individual conductors 70 of the revolving cable 11 with the respective conductors 46 of the stationary cable 10. In order to provide maximum electrical separation between the brushes when more than one brush rack 67 is employed, the brushes 15 associated with any adjacent pair of slip rings 14 are positioned on different brush racks 67.

The split construction of the rotary junction assembly 1 greatly facilitates installation and maintenance thereof. The rotary assembly 1 is positioned near the junction of the stationary support member 8 and rotary support member 9. Before installation of the stator 4 onto the stationary support member 8, the individual conductors 46 of the stationary cable 10 are connected to the slip rings 14. The assembly of brush racks 67 connected by the brackets 94 is then engaged with the guide tracks 77 of one of the hinged stator halves 2 as the individual brushes 15 are tracked onto corresponding slip rings 14 and the stator halves are clamped onto the stationary support member 8 by engagement of the fasteners 24 with the stator mounting webs 23. The individual conductors 70 of the revolving cable 11 are connected to the respective brushes 15. The housing halves 65 are then positioned around the stator 4 in such a manner that the brush rack engaging walls 96 engage the ends 95 of the brackets 94, and the housing halves 65 are connected together by engagement of the fasteners 87 with the flanges 84. The principal maintenance that is necessary with the rotary junction assembly 1 is the periodic removal of corrosion and dust from the brushes 15 and slip rings 14 and inspection thereof for wear. In most cases such maintenance may be accomplished simply by removing the housing 64. Should it become necessary to replace any of the brushes 15 or slip rings 14, the stator assembly with the brush racks 67 thereon may be removed very simply by removal of the fasteners 24 and disconnection of the cables 10 and 11. Alternatively, brushes may be employed which are retained in holders that have snap-in, snap-out means whereby the brushes can be replaced or cleaned without removing the brush racks 67.

Under some circumstances, such as when the rotary junction assembly 1 is employed in a system which rotates at a relatively rapid speed it might be desirable to provide more positive engagement respectively between the rotor and stator and the support members. Such provisions may be provided in a modified junction assembly 105, FIG. 8. The stationary support member 100 includes a key 101 for engagement with a keyway 102 formed in the inner cylindrical surface 103 of the stator 104 of the modified junction assembly 105. In a similar manner, the rotary support member 107 is provided with a key 108 for engagement with a keyway 109 in the collar 110 of the housing 111 of the rotor 112. The modified assembly 105 is otherwise similar to the preferred assembly 1.

FIG. 9 illustrates modified ring halves 123 for use with the rotary junction assembly of the present invention. The modified ring halves 123 include in-turned ends 124 having electrical contacts 125 thereon. The ends 124 of the ring halves are resilient, and electrical continuity between the ring halves 123 is accomplished by mutual engagement of the contacts 125 when the halves of the rotor or stator on which the rings are positioned are swung together. The contacts 125 provide an alternative to the jumpers 40 illustrated in FIG. 5. The modified ring halves 123 may be assembled on backing members 126 in substantially the same manner as the ring halves 14 the backing members 128.

Figure 10:
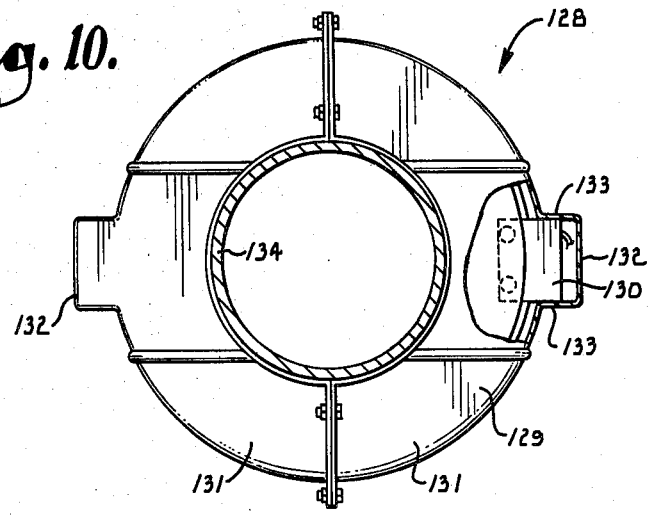
FIG. 10 is a plan view at a diminished scale showing a modified arrangement of brush racks.

FIG. 10 illustrates an alternative embodiment 128 having a modified brush rack assembly and a modified housing 129. In the alternative embodiment 128, the brush racks 130 thereof are not connected by a bracket such as the bracket 94 of the preferred embodiment. In all other respects, the brush racks 130 are substantially similar to the brush racks 67. The halves 131 of the housing 129 are provided with brush rack engaging portions 132 having respective walls 133 for engagement with the brush racks 130 for revolution thereof upon rotation of the rotary support member 134. In the illustrated example, FIG. 10, the rack engaging portions 132 are positioned on diametrically opposite sides of the housing 129. The alternative embodiment 128 is otherwise substantially similar to the preferred rotary junction assembly 1.

Figure 11:
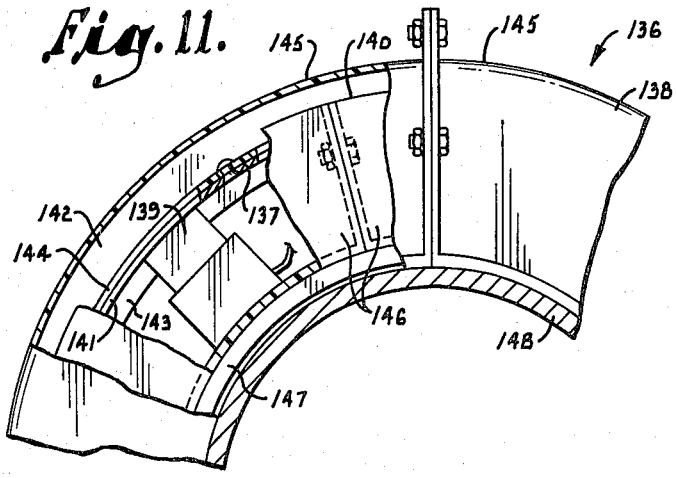
FIG. 11 is an enlarged fragmentary plan view with portions broken away to illustrate a modified form of split rotary junction assembly having brushes positioned on a stator and split rings positioned on a rotor thereof.

FIG. 11 illustrates a modified embodiment 136 of the split construction rotary junction assembly wherein the slip rings 137 are positioned on the rotor 138, and the brushes 139 are positioned on the stator 140. Each slip ring 137 consists of a pair of slip ring halves 141, each slip ring half being mounted on a semi-annular backing member 142 formed of insulation material and including an inwardly projecting and circumferentially extending insulator wall 143 between each adjacent pair of slip ring halves 141. The backing members 142 are substantially similar to the backing members 28 and, although not illustrated, preferably include ends of the insulator walls 143 which overlap in a manner similar to that of the ends 51 of the insulator walls 50 for continuous positive insulation between adjacent slip rings 137. Each slip ring half 141 is mounted on an inside surface of an inner wall 144 of the backing member 142 associated therewith, and the backing members are stacked together and assembled on respective halves 145 of the rotor 138. The brushes 139 may be positioned on one or both of the halves 146 of the stator 40. The respective halves of either the stator 140 or rotor 138 may be connected by hinges (not shown) to facilitate assemblage and removal respectively around a stationary support member 147 and a rotary support member 148.

While certain forms of the present invention have been described and illustrated herein, it is not to be limited thereto except insofar as such limitations are included in the following claims.

What is claimed and desired to secure by Letters Patent is:

1. A rotary electrical junction device comprising:

(a) stator means formed in at least two stator sections;

(b) means securing said stator sections around a stationary support member for selective mutual separation of said stator sections laterally outward from said stationary support member;

(c) stator contact means on said stator means and electrically connected to stationary electrical means;

(d) rotor means formed in at least two rotor sections;

(e) means securing said rotor sections around a rotary support member for selective mutual separation of said rotor sections laterally outward from said rotary support member, said rotary support member being rotatably connected to said stationary support member;

(f) rotor contact means on said rotor means and electrically connected to revolving electrical means associated with said rotary support member, said rotor contact means being in contact with said stator contact means when said junction device is assembled to thereby provide continuous electrical communication between said stationary electrical means and said revolving electrical means, and whereby the laterally outward separability of said stator and rotor sections facilitates the installation and removal of said rotary electrical junction device on and from said stationary and rotary support members;

(g) said rotary support means being rotatable about an axis of rotation and wherein:

(1) said stator means is separable along a stator split plane including said axis of rotation into a pair of stator halves; and (2) said rotor means is separable along a rotor split plane including said axis of rotation into a pair of rotor halves;

(h) said stator contact means being a plurality of slip rings, each of said slip rings being separable into a pair of slip ring halves;

(i) said rotor contact means being a plurality of brushes, each brush being associated with a respective slip ring;

(j) said brushes mounted in side-by-side relation on at least one brush rack;

(k) annular guide means provided on each of said stator halves to receive said brush rack thereon with said brushes conductively engaging respective slip rings such that said brush rack may be revolved about said stator means; and (l) said rotor means including a split construction housing enclosing said stator means and said brush rack, said housing being mounted on said rotary support member and including brush rack engaging means whereby said brush rack is revolved about said stator means upon rotation of said housing.

2. A device as set forth in claim 1 including:

(a) at least two brush racks spaced circumferentially from one another; and (b) bracket means connecting said brush racks whereby said brush racks move in unison.

3. A device as set forth in claim 2 wherein: the brushes associated with respective ones of said plurality of slip rings are located on respective ones of said brush racks.

4. A device as set forth in claim 1 wherein:

(a) said annular guide means includes a circumferential guide track having opposite ends; and (b) said brush rack includes rollers positioned thereon to engage the guide track at said ends.

5. A device as set forth in claim 1 including:

(a) hinge means connecting said stator halves on one side of said stator means; and (b) removable stator fastening means connecting said stator halves on the other side of said stator means to thereby removably clamp said stator halves on said stationary support member.

6. A rotary electrical junction device comprising:

(a) stator means formed in at least two stator sections;

(b) means for securing said stator sections about a stationary support member for selective mutual separation of said stator sections laterally outward;

(c) stator contact means on said stator means and electrically connected to stationary electrical means, said stator contact means including a plurality of slip rings separable into pairs of slip ring halves;

(d) rotor means formed in at least two rotor sections;

(e) means for securing said rotor sections about a rotary support member connectible to said stationary support member and for selective mutual separation of said rotor sections laterally outward;

(f) rotor contact means including a plurality of brushes on said rotor means and electrically connected to revolvable electrical means associated with said rotary support member;

(g) at least one brush rack with said brushes mounted in side-by-side relation thereon;

(h) said stator means being separable along a stator split plane into a pair of stator halves;

(i) annular guide means on each of said stator halves to receive said brush rack with said brushes conductively engaging respective said slip rings for revolution thereabout;

(j) said rotor means including a housing of split construction enclosing said stator means and said brush rack and mounted on said rotary support member; said housing having means engaging said brush rack for revolution thereof about said stator means.

7. A rotary electrical junction device comprising:

(a) stator means formed in at least two stator sections;

(b) means for securing said stator sections about a stationary support member for selective mutual separation of said stator sections laterally outward;

(c) stator contact means on said stator means and electrically connected to stationary electrical means, said stator contact means including a plurality of slip rings separable into pairs of slip ring halves;

(d) rotor means formed in at least two rotor sections;

(e) means for securing said rotor sections about a rotary support member connectible to said stationary support member and for selective mutual separation of said rotor sections laterally outward;

(f) rotor contact means including a plurality of brushes on said rotor means and electrically connected to revolvable electrical means associated with said rotary support member;

(g) at least one brush rack with said brushes mounted in side-by-side relation thereon;

(h) said stator means being separable along a stator split plane into a pair of stator halves;

(i) annular guide means on each of said stator halves to receive said brush rack, said guide means including a circumferential guide track;

(j) said brush rack has rollers mounted thereon engaging said guide track with said brushes conductively engaging respective said slip rings for smooth revolution thereabout;

(k) said rotor means including a housing of split construction enclosing said stator means and said brush rack and mounted on said rotary support member; said housing having means engaging said brush rack for revolution thereof about said stator means.

8. A rotary electrical junction device comprising:

(a) stator means formed in at least two stator sections;

(b) means for securing said stator sections about a stationary support member for selective mutual separation of said stator sections laterally outward;

(c) stator contact means on said stator means and electrically connected to stationary electrical means;

(d) rotor means formed in at least two rotor sections;

(e) means for securing said rotor sections about a rotary support member connectible to said stationary support member and for selective mutual separation of said rotor sections laterally outward;

(f) rotor contact means on said rotor means and electrically connected to revolving electrical means associated with said rotary support member, said rotor contact means being in contact with said stator contact means when said junction device is assembled to provide continuous electrical communication between said stationary electrical means and said revolving electrical means, and whereby the laterally outward separability of said stator and rotor sections facilitates the installation and removal of said rotary electrical junction device on and from said stationary and rotary support members;

(g) one of said stator means and said rotor means including a plurality of slip rings and the other including a brush rack with a plurality of brushes engaging said slip rings;

(h) an annular guide means positioned adjacent said slip rings; and (i) means extending from said brush rack and riding on said guide means to aid in positioning said stator means relative to said rotor means.

9. A rotary electrical junction device comprising:

(a) stator means formed in at least two stator sections;

(b) means for securing said stator sections about a stationary support member for selective mutual separation of said stator sections laterally outward;

(c) stator contact means on said stator means and electrically connected to stationary electrical means;

(d) rotor means formed in at least two rotor sections;

(e) means for securing said rotor sections about a rotary support member for selective mutual separation of said rotor sections laterally outward;

(f) rotor contact means on said rotor means and electrically connected to revolving electrical means associated with said rotary support member, said rotor contact means being in contact with said stator contact means when said junction device is assembled to thereby provide continuous electrical communication between said stationary electrical means and said revolving electrical means, and whereby the laterally outward separability of said stator and rotor sections facilitates the installation and removal of said rotary electrical junction device on and from said stationary and rotary support members;

(g) said rotary support means being rotatable about an axis of rotation and wherein:

(1) said stator means is separable along a stator split plane including said axis of rotation into a pair of stator halves; and (2) said rotor means is separable along a rotor split plane including said axis of rotation into a pair of rotor halves;

(h) means removably clamping said stator halves on said stationary support member;

(i) means removably clamping said rotor halves on said rotary support member;

(j) said stationary support member being cylindrical;

(k) said stator means being substantially annular in shape and having a stator cylindrical inner surface;

(l) each of said stator halves including a stator mounting web extending in the direction of said stator split plane from said axis of rotation; and (m) stator fastener means engaging the respective stator mounting webs on said stator halves to thereby clamp same onto said stationary support member.

10. A device as set forth in claim 9 wherein:

(a) said stationary support member includes stator key means attached thereto;

(b) one of said stator halves includes stator keyway means formed in the cylindrical inner surface thereof; and (c) said stator halves are clamped onto said stationary support member with said stator key means engaging said stator keyway means.

11. A device as set forth in claim 9 wherein said rotary support member is cylindrical, and wherein:

(a) said rotor means includes a collar with a cylindrical collar inner surface, each rotor half including a respective collar half;

(b) said rotor halves have respective edges along which said rotor halves are separable;

(c) a rotor mounting flange extends along the edge of each rotor half, said rotor mounting flange extending in the direction of said rotor split plane and extending adjacent the collar half of said rotor half; and (d) rotor fastener means engage the respective rotor mounting flanges on said rotor halves to fasten said rotor halves together and to clamp the collar halves onto said rotor support member.

12. A rotary electrical junction device comprising:

(a) a stator means formed in at least two stator sections;

(b) a means for mounting said stator sections about a stationary support member for selective mutual separation of said stator sections laterally outward;

(c) electrical contact means on said stator means for connection to a stationary electrical means;

(d) a rotor means formed in at least two rotor sections;

(e) a means for mounting said rotor sections about a rotary support member for selective mutual separation of said rotor sections laterally outward;

(f) one of said rotor means and said stator means including a plurality of slip rings in side-by-side relationship and the other thereof including a plurality of brushes in side-by-side relationship and means positioning said brushes in wiping electrical contact with said slip rings;

(g) said slip rings being divided into laterally separable slip ring sections and positioned in stacked relationship;

(h) each of said slip rings being spaced one from another by an insulator wall member laterally separable into insulator wall sections with interengaging end portions each of a partial thickness of said insulator wall member to form a full thickness of said insulator wall member upon jointure, and extending in side-by-side contact in overlapping relationship to prevent electrical current leakage faults between adjacent said slip rings.

13. The device set forth in claim 12 wherein:

(a) said slip ring sections include abutting end portions;

(b) said end portions having a flexible jumper wire with opposite ends each affixed to one of said end portions and extending therebetween for conductive continuity between each of said slip ring sections.

* * * * *